US005847649A

United States Patent [19]

Collins et al.

[11] Patent Number: 5,847,649

[45] Date of Patent: Dec. 8, 1998

[54] EAS MARKER ASSEMBLIES

[75] Inventors: William P. Collins, Maplewood; Peter J. Zarembo, Shoreview, both of Minn.

[73] Assignee: Minnesota Mining and Manufacturing Company, St. Paul, Minn.

[21] Appl. No.: 621,272

[22] Filed: Mar. 25, 1996

[51] Int. Cl.[6] ..... G08B 13/14

[52] U.S. Cl. ..... 340/572; 340/551; 156/60

[58] Field of Search ..... 340/572, 551; 156/60

[56] References Cited

U.S. PATENT DOCUMENTS

| | | | |
|---|---|---|---|
| 3,765,007 | 10/1973 | Elder | 340/572 |
| 4,717,438 | 1/1988 | Benge et al. | 156/152 |
| 4,900,386 | 2/1990 | Richter-Jorgensen | 156/250 |
| 4,967,185 | 10/1990 | Montean | 340/572 |
| 5,331,313 | 7/1994 | Koning | 340/551 |
| 5,751,256 | 5/1998 | McDonough et al. | 343/873 |

FOREIGN PATENT DOCUMENTS

| | | | |
|---|---|---|---|
| 2132054 | 3/1995 | Canada | G08B 13/24 |
| 0 459 722 A1 | 12/1991 | European Pat. Off. . | |

*Primary Examiner*—Thomas J. Mullen, Jr.
*Assistant Examiner*—Benjamin C. Lee
*Attorney, Agent, or Firm*—Kari H. Bartingale; Peter L. Olson

[57] ABSTRACT

An EAS marker assembly is a packaging and delivery method for large numbers of individual ferromagnetic EAS markers. The assembly is especially suited for use with an automated or semiautomated EAS marker insertion system. The EAS markers have an adhesive layer on each side to allow the markers to be attached between pages of a book. The assembly includes a plurality of markers carried by a differential release liner. The finished assembly can be in either a roll or stack form. When the roll assembly is rolled up, or when a plurality of sheets of markers are assembled in a stack, the easy release side of the differential release liner contacts one of the adhesive layers, and the tight release side of the liner contacts the adhesive layer on the other side of the marker. When the roll assembly is unrolled, or when individual layers are separated from the stack, the easy release side of the differential release liner detaches from its adhesive layer, while the tight release side remains attached to its adhesive layer. Thus, a layer of marker strips on top of a release liner is presented. The differential release liner allows the roll to be unrolled or the individual layers of markers to be separated from the stack while retaining the marker strips in position on the tight release side for automated pick-up and individual release of the strips by an automated insertion system.

19 Claims, 3 Drawing Sheets

EAS MARKER ASSEMBLIES

BACKGROUND

Theft of books from libraries is an ever increasing problem. With limited resources, libraries cannot afford to lose any books, much less those relatively rare and valuable books that are essentially irreplaceable. In the commercial setting, bookstores have an obvious requirement to control shoplifting of expensive inventory, which is necessarily displayed openly and accessibly to the patron and the would-be shoplifter.

Electronic article surveillance (EAS) systems for controlling unauthorized taking of books from libraries and book stores are now well known. An EAS system typically includes markers, such as magnetic markers, which are attached to the books or other articles to be protected. The system also includes detection equipment, usually located near an exit, which causes an alarm to sound when an active marker passes through a detection zone. To allow authorized removal of articles, such as books checked out from a library, dual status markers have been developed which can be turned "on" and "off" as the article is repeatedly checked out and returned.

The markers are generally supplied as individual markers which are manually inserted into the books. When properly placed, the markers are difficult to visually detect, difficult to remove, and do not detract from the readers ability to use and enjoy the book. However, manual installation of individual markers into library collections numbering in the tens of hundreds of thousands is a laborious, expensive and time consuming process. Thus, there is a need in the art for a more efficient manner of inserting markers into books, or onto other articles which are to be protected.

SUMMARY

An electronic article surveillance marker assembly includes a plurality of markers on a release liner. In one embodiment, the marker assembly includes a first adhesive layer on a first side of the markers, a second adhesive layer on a second side of the markers and a differential release liner having an easy release side and a tight release side, positioned such that the tight release side is in contact with the second adhesive layer. In an alternate embodiment, the marker assembly includes an adhesive layer on only one side of the markers, for example, the second side. A length of the marker assembly can be formed into a roll, or the marker assembly can be cut into sheets and placed on top of each other to form a stack of sheets.

BRIEF DESCRIPTION OF THE DRAWINGS

In the drawings, where like numerals refer to like elements throughout the several views.

DETAILED DESCRIPTION

In the following detailed description, reference is made to the accompanying drawings which form a part hereof, and in which is shown by way of illustration a specific embodiment in which the invention may be practiced. It is to be understood that other embodiments may be utilized and structural changes made without departing from the spirit and scope of the present invention.

The present application is directed at a packaging and delivery method for large numbers of individual ferromagnetic EAS markers for use with an automated or semiautomated system which inserts the markers into books. Two exemplary automated insertion systems are described in the copending and commonly assigned U.S. patent applications entitled "APPARATUS AND METHOD FOR AUTOMATICALLY INSERTING MARKERS INTO BOOKS" and "APPARATUS AND METHOD FOR INSERTING MARKERS INTO BOOKS", filed on even date herewith, assigned to the same assignee as the present invention and incorporated herein by reference.

Figure 1:
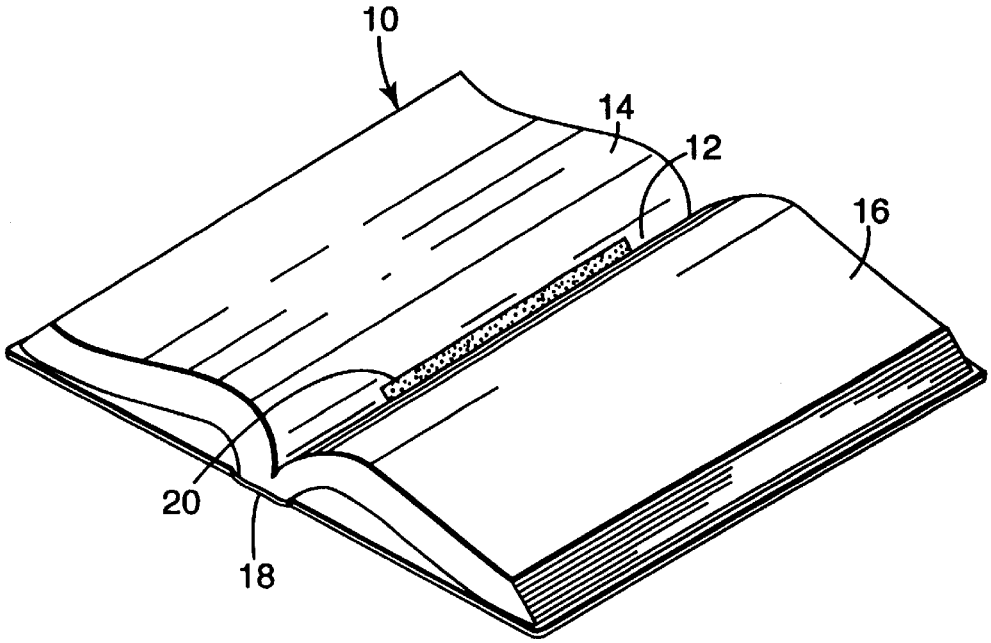
FIG. 1 shows an EAS marker in place in a book.

FIG. 1 shows a marker 20 in a typical placement in a book. The marker 20 is normally positioned in the center channel 12 formed by the pages 14 and 16 when the book 10 is opened. The marker has adhesive on both sides, as described below, that contact the consecutive pages 14 and 16. In this way, the marker becomes attached between the consecutive pages in an inconspicuous way without significant disruption of the shape or use of the book. Alternatively, the marker can be attached inside of the cover in the binding 18 of the book 10.

Figure 2A:
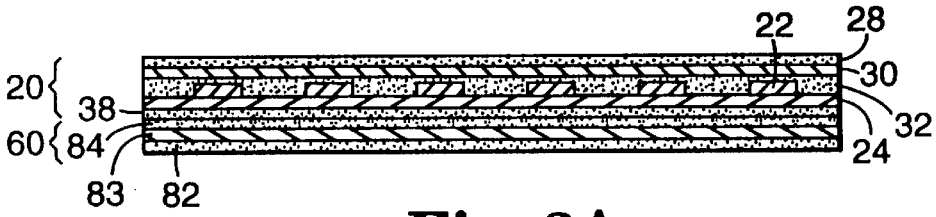
FIGS. 2A and 2B show an end view and a side view, respectively, of a single layer of the preferred EAS marker assembly
Figure 2B:
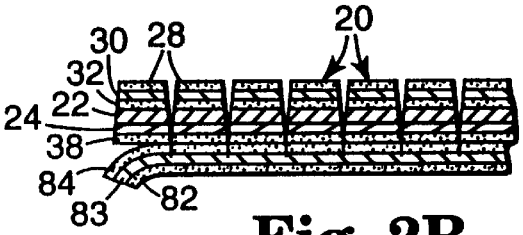

FIGS. 2A and 2B show an end view and a side view of a preferred EAS marker assembly. The marker assembly includes a plurality of marker strips 20 FIG. 2B) carried on a differential release liner 60. Each marker 20 is preferably a dual status ferromagnetic marker having a plurality of high coercive force remanently magnetizable elements 22 positioned adjacent to a narrow, elongated, low coercive force, high permeability strip of magnetic material 24, as described in U.S. Pat. No. 3,765,007, assigned to the same assignee as the present invention and incorporated herein by reference. The strip 24 acts as a signal producing element and has the ability to rapidly switch magnetic orientation when passed through an alternating magnetic field produced in an interrogation zone of an EAS system. The magnetizable elements 22 act as a signal blocking element to control the switching action of the strip 24. When the elements 22 are magnetized, the ability of strip 24 to switch back and forth within the alternating magnetic field is inhibited. In other words, when the elements 22 are magnetized, the marker is "off" and will not result in production of an alarm when passed through the interrogation zone. Alternatively, when the elements 22 are demagnetized, the marker is "on" and the switching action of the strip 24 can take place, resulting in production of an alarm when the marker is passed through the interrogation zone.

In the preferred embodiment, an elongated paper element 30 is attached by an adhesive layer 32 to the magnetizable elements such that the plurality of elements 22 are interposed between the paper element 30 and elongated strip 24, and are in that manner fixedly held in place. In the embodiments shown in FIGS. 2A, 2B and 2C, an adhesive layer 28 is located on the top side of the paper element 50. Another adhesive layer 38 is located on the bottom side of the strip 24. Thnus, the marker has adhesive on both sides. The top and bottom adhesive layers 28 and 38 allow for attachment of the marker 20 between pages of a book as shown and described with respect to FIG. 1.

In an alternative embodiment, the markers 20 include adhesive on only one side. Such a marker may be desirable when the marker is placed in the binding of a book rather than between the pages.

To allow a plurality of markers to be prepared in roll or stack form, a liner 60 is used as a carrier for the markers. The continuous liner 60 is preferably a differential release liner and comprises a liner sheet 83, tight release side 84 and easy release side 82. The differential release liner allows a large number of markers 20 to be preferably provided in the marker roll assembly 50 or the marker stack assembly 80 as shown and described below with respect to FIGS. 3A and 3B. The differential release liner 60 is preferably a polyester film, coated on the back side with easy release silicon 82, and coated on the front side with tight release silicon 84. Each marker is preferably made of a strip of Permalloy foil 24, six strips ARNOKROM 3 foil 22, paper element 30 with adhesive layer 32, and the top and bottom adhesive layers 28 and 38. The sheet 85 of markers is cut to form a plurality of individual marker strips 20, as can be seen in the side view of FIG. 2B.

Figure 3B:
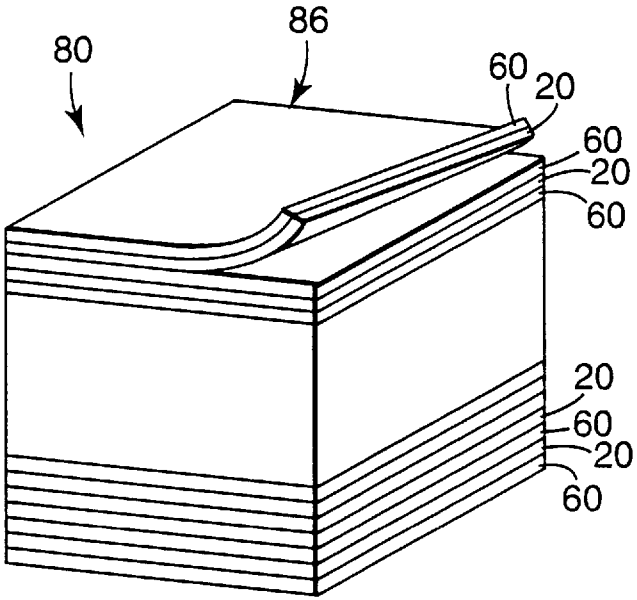
FIG. 3B shows a stack embodiment of the EAS roll assembly.
Figure 3A:
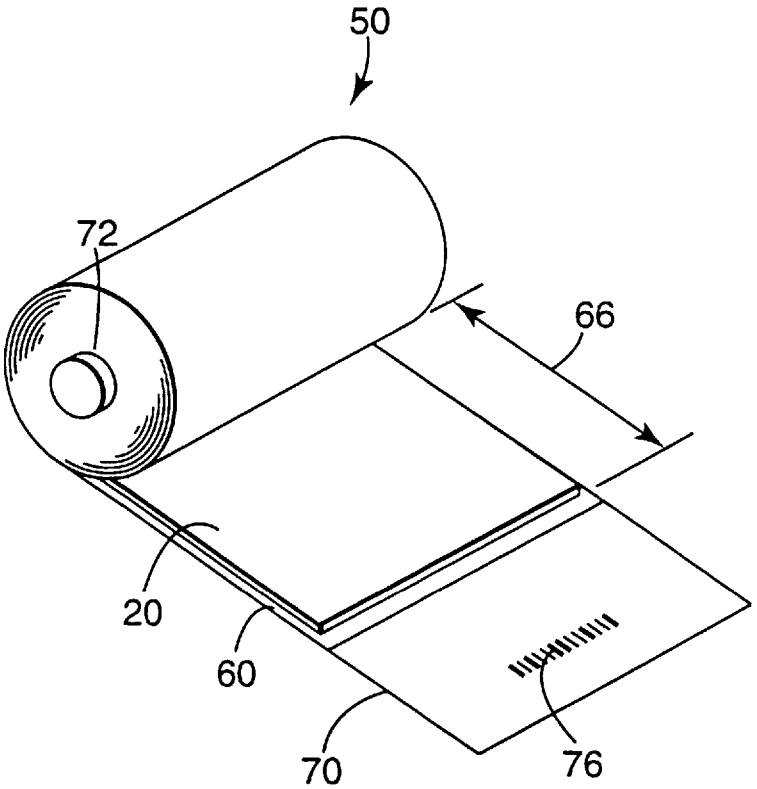
FIG. 3A shows a roll embodiment of the EAS marker assembly.

The roll assembly 50 shown in FIG. 3A includes plurality of markers 66 carried by a differential release liner 60, a leader section 70 and a tail section (not shown). The roll can be wound around a core 72, if desired. The leader section 70 aids feeding of the roll into an automated insertion system, and is preferably free of markers to eliminate waste of markers at the beginning of a roll. The trailer section, attached to the differential release liner 60 at the end of the roll, is also preferably free of markers to eliminating waste of markers at the end of a roll. The leader and tail sections can be attached by any appropriate mechanism, such as 3M brand number 8402 or 8403 splicing tape.

In one preferred embodiment, the leader section 70 includes an intelligent information section 76 readable by the automated insertion system. The intelligent information section could include information such as identification of the particular type of markers on the roll, setup information for the automated insertion system, the number of markers in the roll, authentication of the roll, etc. For example, a BAR code, such as that shown in FIG. 3A, could be used as the intelligent information section 76. The BAR code information could be optically read and processed with a standard CCD image capture device digital data processing system and used for automated control of the machine. Another system could utilize a passive chip attached to the leader that could be read by an electronic scanner and digital data processing system.

The stack assembly 80 shown in FIG. 3B includes a plurality of sheets of markers 20 carried on release liner 60, stacked on top of one another. The resulting stack 80 is thus comprised of differential release liner 60 and marker layers 20. Each sheet in the preferred stack assembly 80 has multiple markers positioned such that the long axis of the markers are parallel to each other across the width of the sheet. When the sheets are placed on top of each other to form the stack, the easy release side 82 of the liner 60 contacts the adhesive layer 28, and the tight release side 84 of the liner 60 contacts the adhesive layer 38. The differential release liner 60 allows the sheets of markers to be stacked to form a compact package without requiring two liners, one on each side of the marker. When a sheet is peeled away from the stack, as illustrated by sheet 86 in FIG. 3B, the easy release side 82 of the differential release liner 60 detaches from the adhesive layer 28, while the tight release side 84 remains attached to the adhesive layer 38. Thus, a sheet of marker strips on top of a release liner 60 is presented. In an automated insertion system, the differential release allows sheets to be removed from the stack while retaining the marker strips in position on tight release side 38 for automated pick-up and individual release of the strips.

In the preferred embodiment of either the roll assembly or the stack assembly, the tight relase side 84 has a typical release value of about 60 grams/force per 2.54 cm (1 inch) width, and the easy release side 82 has a typical release value of about 10 grams/force per 2.54 cm (1 inch) width. In alternative embodiments, the tight relase side 84 could have a release value ranging from about 50 grams/force per 2.54 cm (1 inch) width to about 175 grams/force per 2.54 cm (1 inch) width. The easy relase side 82 preferably has some value of adherence to help prevent undesired unrolling of the roll assembly, and to help keep the stack assembly from separating into individaul marker sheets. However, the easy release side 82 could have a release value ranging from 0 grams/force per 2.54 cm (1 inch) width (no adherance) to about 60 grams/force per 2.54 cm (1 inch) width. In general, however, the values for the easy release side 82 and the tight release side 84 should be chosen such that when the roll assembly is unrolled or when a marker sheet is removed from the stack, the easy release side 82 of the differential release liner 60 detaches from the adhesive layer 28, while the tight release side 84 remains attached to the adhesive layer 38, thus resulting in the layer of markers attached on the tight release side 84 of the differential release liner 60.

Figure 2C:
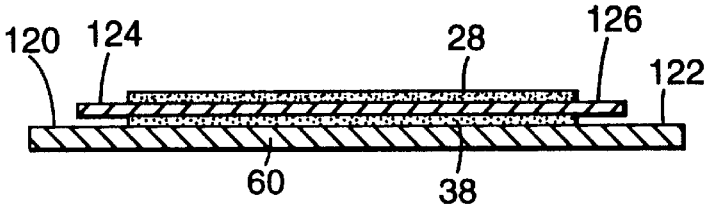
FIG. 2C shows a side view of an alternative embodiment.

In an alternate preferred embodiment of the marker sheet, shown in end view in FIG. 2C, the marker sheets are fabricated such that the component layers are positioned to provide material handling zones 120 and 122 for controlling unwind or positioning of the roll or stack assembly, and adhesive free zones 124 and 126 useful for, for example, handling of the markers by an automated insertion system. The material handling zones 120 and 122 cooperate with a drive mechanism in an automated insertion system for steering, unwinding and advancement of the roll assembly or the stack assembly through an automated insertion system. The adhesive free zones 124 and 126 provide for the handling of individual markers by gripping mechanisms in the automated insertion system. This design helps to prevent machine malfunction due to handling materials buildup, such as waste liner, or deposit and buildup of adhesive on the working parts of an automated insertion system.

Whether material handling zones and adhesive free zones are required, and thus whether a marker such as that shown in FIG. 2A or FIG. 2C depends upon the particular insertion device being used.

Figure 4:
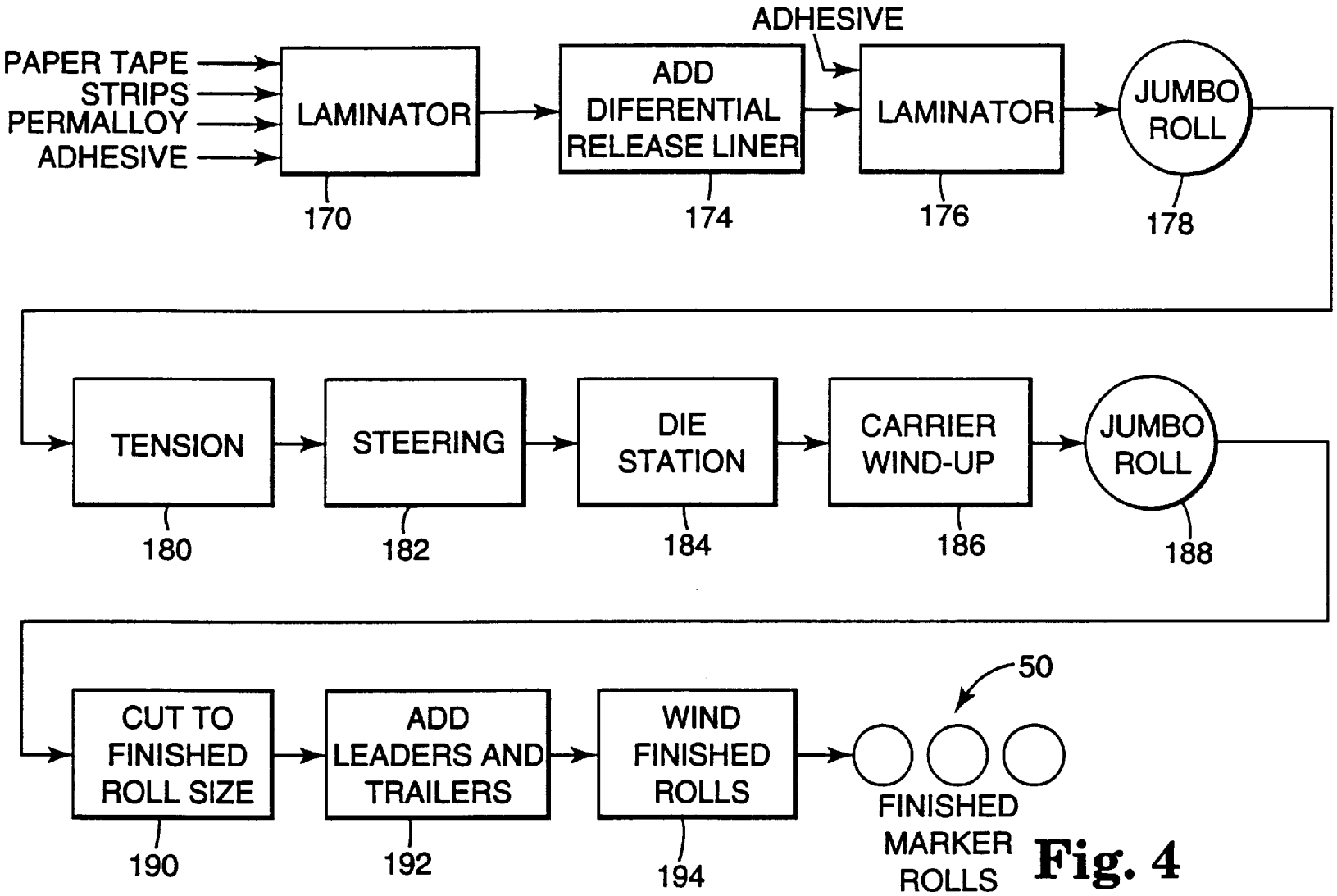
FIG. 4 shows a block diagram of the process of manufacturing the EAS marker assembly.

FIG. 4 illustrates the continuous process for manufacturing of the preferred marker assemblies. Paper element 30 with adhesive layer 32, ARNOKROM 3 strips 22, PERMALLOY foil 24 and bottom adhesive layer 38 are feed into a laminator 170. The differential release liner sheet is introduced at 174 and is attached to the bottom adhesive layer 38. The release liner preferably has a width having an average error of zero from the desired width. This ensures that the liner can be properly fed through the continuous process without causing the processing equipment to jam or otherwise malfunction. The laminated composite and the top adhesive layer 28 are then fed into a second laminator 176. A temporary liner of high density polyethylene film is attached to the top adhesive layer 28 and the material is gathered into a jumbo roll 178 for subsequent conversion.

Individual markers are preferably formed from the composite marker layers by die cutting. The die cutting station 184 is preferably set up to cut through the marker portion of the composite forming 0.32 mm (⅛ inch) wide strips in a precise cross web direction. To ensure that the length of markers is cut perpendicular to the release liner, the die cutting station preferably cuts the length of marker material such that the average error from the perpendicular is zero. This ensures that over several makers, the markers are located in a precise cross web direction. This ensures that the markers are "straight" on the release liner and that the length of marker material will always be properly lined up in the automatic insertion machine. To ensure that each marker is completely separated from those adjacent to it and to aid in the handling of the individual markers by an automated insertion system, the die cut preferably extends at least 0.015 mm (0.6 mils) down into the release liner 60. However, for automated handling it is important that the release liner 60 not be cut all the way through and that the markers are maintained as a plurality of marker strips on a release liner. After die cutting, the temporary liner is removed at carrier windup 186, and the material is wound into jumbo rolls 188 for final processing into finished marker roll assembly.

The jumbo rolls 188 are cut to finished roll size at 190 and the leaders 70 and trailers 72, if desired, are attached at 192. The resulting lengths of material are then wound at 194 to complete the finished marker rolls 50.

To make the marker stack assembly, the same steps in FIG. 4 are followed, except that the sheets are cut to the desired stack length in block 190, and the individual layers are assembled in stack form in block 194.

Although specific embodiments have been shown and described herein for purposes of illustration of exemplary embodiments, it will be understood by those of ordinary skill that a wide variety of alternate and/or equivalent implementations designed to achieve the same purposes may be substituted for the specific embodiments shown and described without departing from the scope of the present invention. Those of ordinary skill will readily appreciate that the present invention could be implemented in a wide variety of embodiments. This application is intended to cover any adaptations or variations of the preferred embodiments discussed herein. Therefore, it is intended that this invention be defined by the claims and the equivalents thereof.

We claim:

1. An electronic article surveillance marker assembly, comprising at least one sheet of markers, and further each sheet comrpises:

a plurality of markers;

a first adhesive layer on a first side of the markers;

a second adhesive layer on a second side of the markers;

a differential release liner having an easy release side and a tight release side, positioned such that the tight release side is in contact with the second adhesive layer.

2. The marker assembly according to claim 1 further including material handling zones provided for handing of the markers.

3. The marker assembly according to claim 1 further including adhesive free zones.

4. The marker assembly according to claim 1 wherein the plurality of markers are aligned parallel to each other on the assembly.

5. The marker assembly according to claim 1 wherein the easy release side of the differential release liner has a release value less than that of the tight release side of the differential relase liner.

6. The marker assembly according to claim 1 wherein the easy release side of the differential release liner has a release value of less than 20 grams-force per 1 inch width.

7. The marker assembly according to claim 1 wherein the easy release side of the differential release liner has a release value of less than 10 grams-force per 1 inch width.

8. The marker assembly according to claim 1 wherein the assembly is in stack form.

9. The marker assembly according to claim 8 wherein the assembly comprises a plurality of sheets forming a stack.

10. The marker assembly according to claim 1 wherein the markers are dual status markers.

11. The marker assembly according to claim 10 wherein each marker comprises:

a signal producing layer of low coercive force, high permeability magnetic material; and a signal blocking layer including a plurality of high coercive force, remanently magnetizable elements disposed along one side of the signal producing layer.

12. The marker assembly according to claim 1 wherein the tight release side of the differential release liner has a release value of at least 30 grams-force per 1 inch width.

13. The marker assembly according to claim 12 wherein the tight release side of the differential release liner has a release value of at least 60 grams-force per 1 inch width.

14. The marker assembly according to claim 1 wherein the assembly is in roll form.

15. The marker assembly according to claim 14 wherein the easy release side is in contact with the first adhesive layer.

16. The marker assembly according to claim 15 further including a trailer section attached to an inside end of the roll.

17. The marker assembly according to claim 14 further including a leader section attached to an outside end of the roll.

18. The marker assembly according to claim 17 further including an authentication means attached to the leader section, for reading by an automated insertion system.

19. The marker assembly according to claim 18 wherein the authentication means includes a barcode.

* * * * *